US011841125B2

(12) United States Patent
Martinez Weber

(10) Patent No.: US 11,841,125 B2
(45) Date of Patent: Dec. 12, 2023

(54) OPTICAL DEVICE AND DESK LAMP COMPRISING SAID OPTICAL DEVICE

(71) Applicant: ANTARES ILUMINACIÓN, S.A.U., Valencia (ES)

(72) Inventor: Federico Martinez Weber, Valencia (ES)

(73) Assignee: ANTARES ILUMINACION, S.A.U., Valencia (ES)

( * ) Notice: Subject to any disclaimer, the term of this patent is extended or adjusted under 35 U.S.C. 154(b) by 0 days.

(21) Appl. No.: 17/783,481

(22) PCT Filed: Apr. 2, 2020

(86) PCT No.: PCT/ES2020/070217
§ 371 (c)(1),
(2) Date: Jun. 8, 2022

(87) PCT Pub. No.: WO2021/198537
PCT Pub. Date: Oct. 7, 2021

(65) Prior Publication Data

US 2023/0011942 A1 Jan. 12, 2023

(51) Int. Cl.

| | |
|---|---|
| ***F21S 6/00*** | (2006.01) |
| ***F21V 5/04*** | (2006.01) |
| ***F21V 7/00*** | (2006.01) |

(52) U.S. Cl.
CPC ..... *F21S 6/003* (2013.01); *F21V 5/045* (2013.01); *F21V 7/0091* (2013.01)

(58) Field of Classification Search
CPC ..... F21S 6/003; F21V 5/045; F21V 7/0091
See application file for complete search history.

(56) References Cited

U.S. PATENT DOCUMENTS

| | | | | |
|---|---|---|---|---|
| 2019/0137046 | A1* | 5/2019 | Hwang | F21S 43/245 |
| 2019/0338917 | A1 | 11/2019 | Chen et al. | |
| 2020/0332966 | A1* | 10/2020 | Hwang | F21V 5/005 |

FOREIGN PATENT DOCUMENTS

| | | | |
|---|---|---|---|
| CN | 208794133 | U | 4/2019 |
| EP | 3453939 | A1 | 3/2019 |
| EP | 3534057 | A1 | 9/2019 |
| WO | 2006033770 | A3 | 3/2006 |
| WO | 2019134892 | A1 | 7/2019 |

* cited by examiner

*Primary Examiner* — Thomas M Sember
(74) *Attorney, Agent, or Firm* — Hayes Soloway PC

(57) ABSTRACT

The present invention relates to an optical device that enables a light beam from a light source to be redirected in a specific direction and without having to adjust the tilt angle of the light source with respect to a horizontal working plane, distributing the light homogeneously in said horizontal working plane, wherein the invention furthermore relates to a desk lamp comprising said optical device which avoids the problem of blinding generated by the direct line of sight of the light source, since the light source is arranged below the viewing plane of a user who uses said desk lamp, in addition to the fact that said desk lamp does not invade the user's work area.

12 Claims, 6 Drawing Sheets

B-B

A-A

OPTICAL DEVICE AND DESK LAMP COMPRISING SAID OPTICAL DEVICE

CROSS-REFERENCE TO RELATED APPLICATIONS AND PRIORITY

This patent application claims priority from PCT Application No. PCT/ES2020/070217 filed Apr. 2, 2020. This patent application is herein incorporated by reference in its entirety.

OBJECT OF THE INVENTION

The present invention relates to an optical device that enables a light beam from a light source to be redirected in a specific direction and without having to adjust the tilt angle of the light source with respect to a horizontal working plane, distributing the light homogeneously in said horizontal working plane.

The object of the invention is also a desk lamp comprising said optical device which avoids the problem of blinding generated by the direct line of sight of the light source, since the light source is arranged below the viewing plane of a user who uses said desk lamp, in addition to the fact that said desk lamp does not invade the user's work area.

BACKGROUND OF THE INVENTION

Various types of desk lamps are known in the prior art, which comprise a base intended to rest on or be attached to the desk and a support that joins the base to a light source, wherein said light source usually has a reflection screen that limits the light output at a specific angle.

In these types of desk lamps, the support and/or the light source have different degrees of freedom so that they can be arranged in the position required by the user, such that the light source is normally located above the user's vision, wherein the user's own head generates a shadow in the area to be illuminated, or in order to specifically avoid this drawback, it must be directed in a direction oblique to the horizontal working plane or also in an essentially vertical direction, wherein it is necessary to adjust the tilt angle of the light source with respect to a horizontal plane or with respect to the essentially vertical direction, such that blinding is often produced by the direct line of sight of the light source by the user.

Furthermore, said desk lamps often invade the user's work area or the viewing of elements arranged in front of the user due to the position adopted by the support and/or the light source to achieve the desired lighting in the user's work area.

The optical device and the desk lamp comprising said optical device overcome all the previously described drawbacks.

DESCRIPTION OF THE INVENTION

The optical device of the present invention enables redirecting a light beam from a light source intended to radiate in an essentially vertical downward direction and without having to adjust the tilt angle of the light source with respect to a horizontal working plane, distributing the light homogeneously in said horizontal working plane.

The optical device comprises

- a light source intended to radiate a light beam in an essentially vertical downward direction;
- a lens that in turn comprises:

- a first total internal reflection (TIR) surface through which the light beam is reflected; and
  - a second faceted surface through which the light beam is refracted;

wherein the first surface is closer to the light source than the second surface.

Optionally, the second faceted surface comprises a plurality of first faces and a plurality of second faces, wherein each of the faces of the plurality of first faces is arranged alternating with a second face of the plurality of second faces.

Optionally, the plurality of first faces comprises a first tilt angle with respect to the essentially vertical downward direction, and the plurality of second faces comprises a second tilt angle with respect to the essentially vertical downward direction, i.e., establishing the origin of angles coinciding with the essentially vertical downward direction. Preferably, the first tilt angle is between 180° and 270° with respect to the essentially vertical downward direction, and the second tilt angle is between 90° and 180° with respect to the essentially vertical downward direction, or the conjugates thereof, i.e., between 120° and 90° and between 270° and 180°, respectively. More preferably, the first tilt angle is between 210° and 270° with respect to the essentially vertical downward direction, and the second tilt angle is between 120° and 180° with respect to the essentially vertical downward direction, or the conjugates thereof, i.e., between 150° and 90° and between 180° and 120°, respectively. In this way, the light coming from the light source intended to radiate in an essentially vertical downward direction is redirected in an oblique direction with respect to the essentially vertical downward direction towards the area to be illuminated, or, in other words, asymmetrically with respect to the essentially vertical downward direction.

Optionally, each of the faces of the plurality of first faces are straight faces, while each of the faces of the plurality of second faces are curved faces. Preferably, each of the curved faces of the plurality of second faces are concave, taking the essentially vertical downward direction as a reference. In this way, the light beam coming from the light source is homogenised when passing through the lens thus configured, which enables a screening or cut-off angle of less than 78° to be obtained.

Optionally, the height of the lens is less than 10 mm, which enables the light to be redirected and homogenised in a small space.

The invention also relates to a desk lamp comprising the optical device described previously, which avoids the problem of blinding generated by the direct line of sight of the light source, since the light source is arranged below the viewing plane of a user who uses said desk lamp, in addition to the fact that said desk lamp does not invade the user's work area.

The desk lamp further comprises a base intended to rest on or be attached to a desk and a support that joins the base to the lens of the optical device, wherein the light source is integrated into the support and wherein the support that joins the base to the light source is rigid, since it is not necessary to adjust the degree of tilt of the support and/or the light source with the previously described configuration of the lens of the optical device.

Furthermore, the configuration of the desk lamp is such that the light source is arranged at a height of less than 35 cm from the desk on which the base is intended to rest or be attached, the combined height of the base, the support and the light source preferably being less than 35 cm, which enables an essentially elliptical illuminated area with a diameter greater than at least 700 mm and a diameter less than at least 500 mm and with an illumination level of at least 1000 lx to be obtained on the desk.

DESCRIPTION OF THE DRAWINGS

As a complement to the description provided herein, and for the purpose of helping to make the features of the invention more readily understandable, in accordance with a preferred practical exemplary embodiment thereof, said description is accompanied by a set of drawings constituting an integral part of the same, which by way of illustration and not limitation, represent the following.

PREFERRED EMBODIMENT OF THE INVENTION

Figure 1:
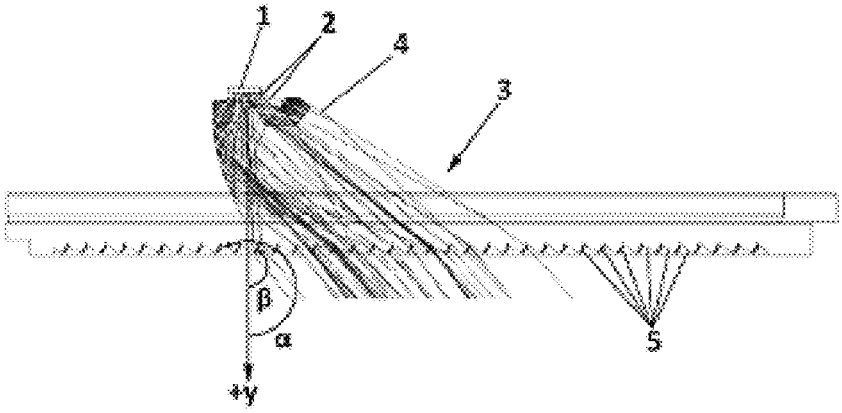
FIG. 1 shows a cross-sectional view of the optical device of the present invention wherein the distribution of the light rays emitted by the light source as it passes through the lens has been represented.
Figure 2:
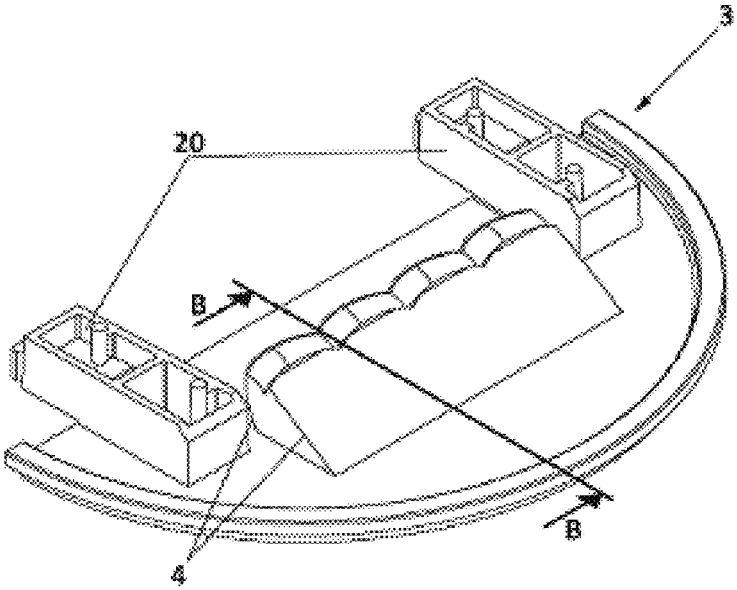
FIG. 2 shows a top perspective view of the lens of the optical device of the present invention.

The optical device of the present invention is described below in detail.

The optical device comprises

- a light source (1) intended to radiate a light beam (2) in an essentially vertical downward direction;
- a lens (3) that in turn comprises:
  - a first total internal reflection surface (4) through which the light beam (2) is reflected; and
  - a second faceted surface (5) through which the light beam (2) is refracted;

wherein the first surface (4) is closer to the light source (1) than the second surface (5).

As seen in FIG. 1, the distribution of the light rays of the light beam emitted by the light source as it passes through the lens has a first area delimited by the first surface (4) wherein the light rays are internally and totally reflected and an area after the light rays pass through the second surface (5) wherein said light rays are refracted and are obliquely redirected to the area to be illuminated.

Figure 3:
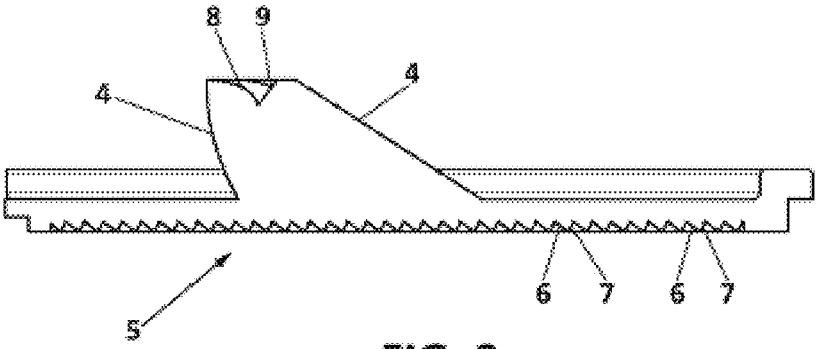
FIG. 3 shows a cross-sectional view BB of the lens of the optical device of the present invention.
Figure 4:
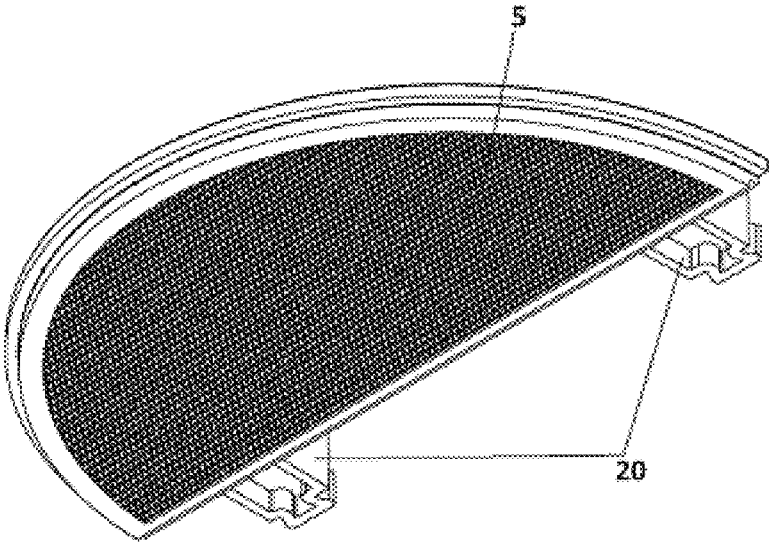
FIG. 4 shows a bottom perspective view of the lens of the optical device of the present invention.
Figure 5:
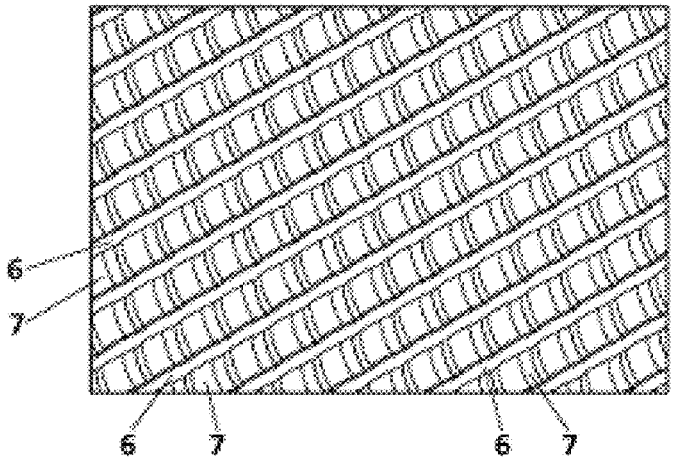
FIG. 5 shows a detailed view of FIG. 4, wherein the second faceted surface through which the light beam from the lens of the optical device of the present invention is refracted is observed.

FIG. 3 shows a cross-sectional view BB of the lens of the optical device of the present invention, wherein it is observed that the second faceted surface (5) comprises a plurality of first faces (6) and a plurality of second faces (7), wherein each of the faces (6) of the plurality of first faces (6) is arranged alternating with a second face (7) of the plurality of second faces (7), wherein each of the faces (6) of the plurality of first faces (6) are straight faces, while each of the faces (7) of the plurality of second faces (7) are curved faces. Preferably, each of the curved faces of the plurality of second faces (7) are concave, taking the essentially vertical downward direction (+Y) as a reference. Furthermore, the light beam (2) coming from the light source is homogenised when passing through the lens thus configured, which enables a screening or cut-off angle of less than 78° to be obtained.

Preferably, as seen in FIG. 3, the cross section of the first total internal reflection surface (4) through which the light beam (2) is reflected is a first curved face (8) and a second straight face (9).

The lens (3) further comprises third refractive surfaces (10, 11) through which the light beam (2) enters the lens (3), arranged between the light source (1) and the first total internal reflection surface (4), these third surfaces (10, 11) preferably being curved and/or straight.

Optionally, the height of the lens from the third surfaces (10, 11) to the second surface (5) is less than 10 mm, which enables the light to be redirected and homogenised in a small space.

Figure 6:
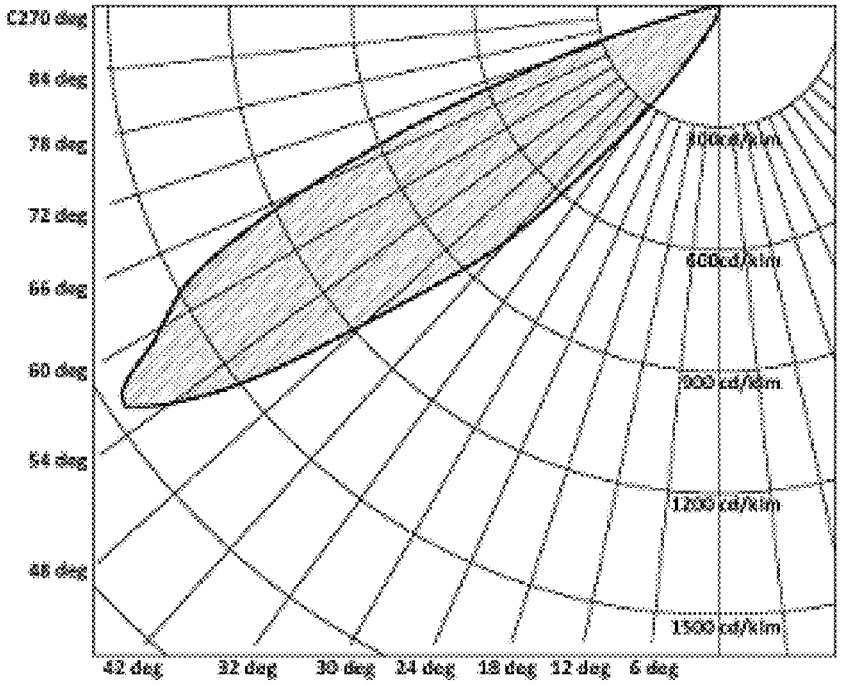
FIG. 6 shows the angular distribution of light intensity of the optical device of the present invention wherein it is observed that the light beam is below a cut-off angle of 78°.
Figure 7:
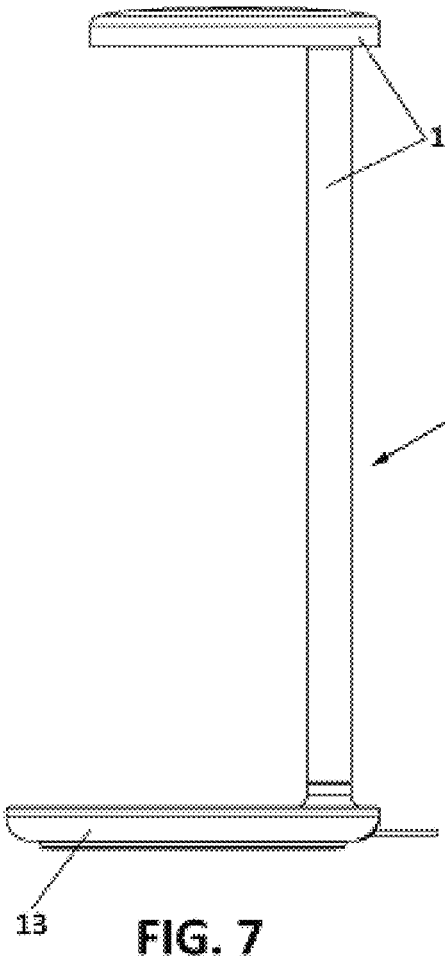
FIG. 7 shows a rear elevation view of the desk lamp of the present invention.

The plurality of first faces (6) comprises a first tilt angle ($\alpha$) with respect to the essentially vertical downward direction (+Y), and the plurality of second faces (7) comprises a second tilt angle ($\beta$) with respect to the essentially vertical downward direction (+Y), i.e., establishing the origin of angles coinciding with the essentially vertical downward direction (+Y). Preferably, the first tilt angle ($\alpha$) is between 180° and 270° with respect to the essentially vertical downward direction, and the second tilt angle ($\beta$) is between 90° and 180° with respect to the essentially vertical downward direction, or the conjugates thereof, i.e., between 120° and 90° and between 270° and 180°, respectively. More preferably, the first tilt angle ($\alpha$) is between 210° and 270° with respect to the essentially vertical downward direction, and the second tilt angle ($\beta$) is between 120° and 180° with respect to the essentially vertical downward direction, or the conjugates thereof, i.e., between 150° and 90° and between 180° and 120°, respectively. Still more preferably, the first tilt angle ($\alpha$) is essentially 240° with respect to the essentially vertical downward direction, and the second tilt angle ($\beta$) is essentially 150° with respect to the essentially vertical downward direction, or the conjugates thereof, i.e., essentially 120° and essentially 210°, respectively. In this way, the light coming from the light source (1) intended to radiate in an essentially vertical downward direction (+Y) is redirected in an oblique direction with respect to the essentially vertical downward direction (+Y) towards the area to be illuminated, or, in other words, asymmetrically with respect to the essentially vertical downward direction. (+Y), and is homogenised when passing through the lens thus configured, which enables a screening or cut-off angle of less than 78° to be obtained, as shown in FIG. 6.

FIGS. 7 to 11 show the desk lamp (30) comprising the optical device described previously.

The desk lamp (30) further comprises a base (13) intended to rest on or be attached to a desk and a support (14) that joins the base (13) to the lens (3) of the optical device, wherein the light source (1) is arranged on the support (14). The support (14) that joins the base (13) to the light source (1) is rigid, since it is not necessary to adjust the degree of tilt of the support (14) and/or the light source (1) with the previously described configuration of the lens (3) of the optical device.

Figure 8:
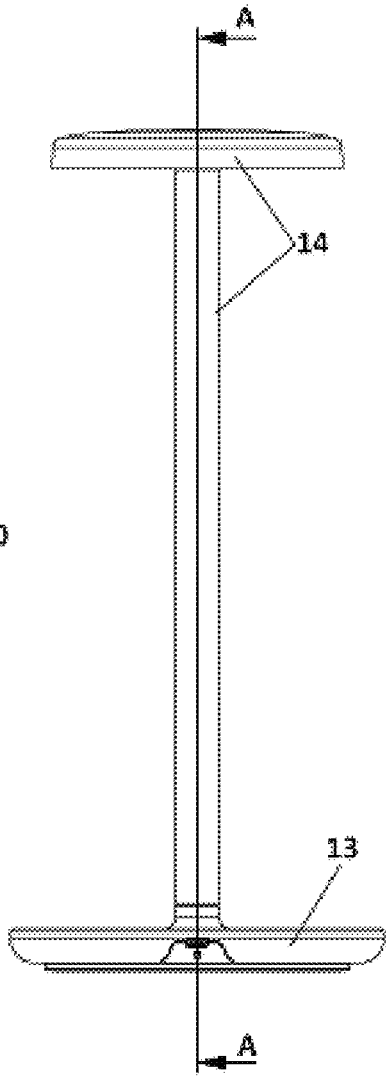
FIG. 8 shows a rear view of the desk lamp of the present invention.
Figure 9:
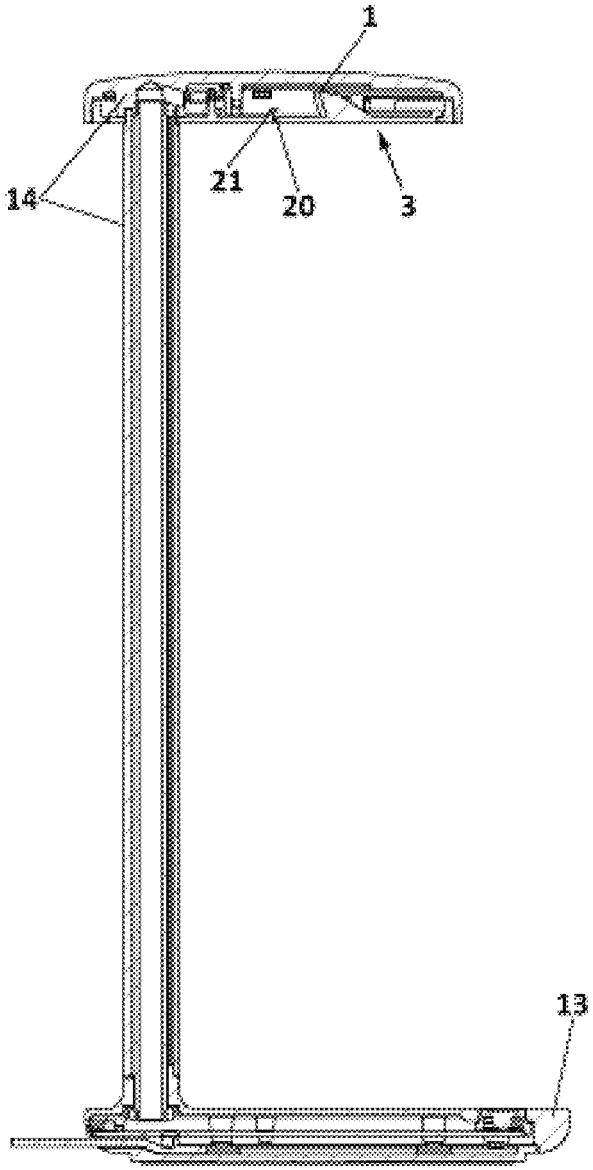
FIG. 9 shows a cross-sectional view AA of FIG. 8.

FIG. 9 shows a cross-sectional view AA of FIG. 8 wherein it is observed that the lens (3) of the optical device is integrated into the desk lamp (30) by means of anchoring means (20) arranged in said lens (3), which are opposite from anchoring means (21) present in the support (14) of the desk lamp (30).

Figure 10:
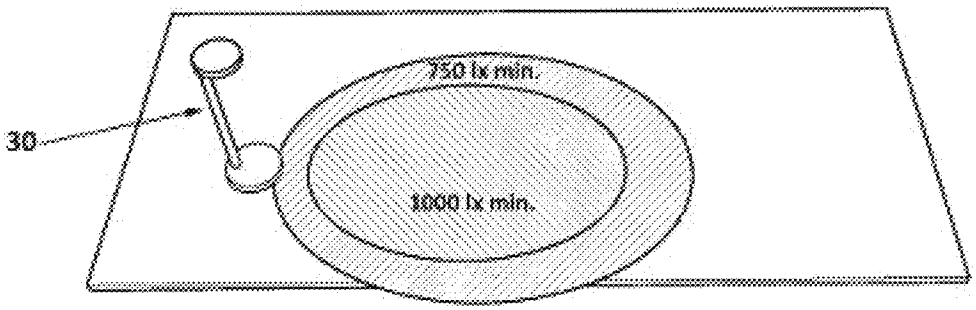
FIG. 10 shows a perspective view of the desk lamp of the present invention illuminating a work area.

FIG. 10 shows the desk lamp (30) arranged on a desk (15) or horizontal surface, wherein the light source (1) is arranged at a height of less than 35 cm from the desk (15) on which the base (13) is intended to rest or be attached, the combined height of the base (13) and the support (14) wherein the light source (1) is integrated being preferably less than 35 cm, which enables an essentially elliptical illuminated area with a diameter greater than at least 700 mm and a diameter less than at least 500 mm and with an illumination level of at least 1000 lx to be obtained on the desk. Preferably, an elliptical crown-shaped illuminated area arranged outside the essentially elliptical illuminated area with a diameter greater than at least 700 mm and a diameter less than at least 500 mm and with an illumination level of at least 750 lx is also obtained.

Figure 11:
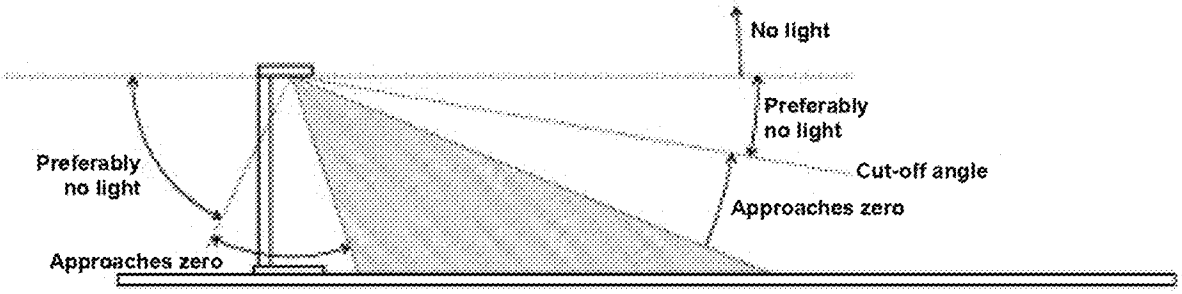
FIG. 11 shows an elevation view of FIG. 10.

FIG. 11 shows an elevation view of the area illuminated by the optical device of the present invention integrated into the desk lamp which is also object of the present invention, wherein the area where the illumination level is of at least 1000 lx, and the adjacent areas wherein the illumination level decreases until reaching the cut-off angle, which gives way to areas where the illumination level is practically imperceptible, followed by areas where the lighting level is null, are observed.

The invention claimed is:

1. An optical device comprising:

a light source intended to radiate a light beam in an essentially vertical downward direction;

a lens that in turn comprises:

a first total internal reflection surface through which the light beam is reflected; and a second faceted surface through which the light beam is refracted, wherein the second faceted surface comprises a plurality of first faces and a plurality of second faces, wherein each of the faces of the plurality of first faces is arranged alternating with a second face of the plurality of second faces;

wherein each of the faces of the plurality of first faces are straight faces, while each of the faces of the plurality of second faces are curved faces;

wherein the first surface is closer to the light source than the second surface;

wherein the distribution of the light rays of the light beam emitted by the light source as it passes through the lens has a first area delimited by the first surface wherein the light rays are internally and totally reflected and an area after the light rays pass through the second surface wherein said light rays are refracted and are obliquely redirected to the area to be illuminated;

and wherein each of the curved faces of the plurality of second faces are concave, taking the essentially vertical downward direction as a reference, whereby the light beam is homogenized when passing through the lens with a screening or cut-off angle of less than 78°.

2. The optical device according of claim 1, wherein the plurality of first faces comprises a first tilt angle with respect to the essentially vertical downward direction, and the plurality of second faces comprises a second tilt angle with respect to the essentially vertical downward direction, so establishing the origin of angles coinciding with the essentially vertical downward direction.

3. The optical device of claim 2 wherein the first tilt angle is between 180° and 270° with respect to the essentially vertical downward direction, and the second tilt angle is between 90° and 180° with respect to the essentially vertical downward direction, or the conjugates angles, that is to say, between 120° and 90° and between 270° and 180°, respectively.

4. The optical device of claim 3, wherein the first tilt angle is between 210° and 270° with respect to the essentially vertical downward direction, and the second tilt angle is between 120° and 180° with respect to the essentially vertical downward direction, or the conjugates thereof, i.e., between 150° and 90° and between 180° and 120°, respectively.

5. The optical device of claim 4, wherein the first tilt angle is essentially 240° with respect to the essentially vertical downward direction, and the second tilt angle is essentially 150° with respect to the essentially vertical downward direction, or the conjugates thereof, i.e., essentially 120° and essentially 210°, respectively.

6. The optical device of claim 1, wherein the cross section of the first total internal reflection surface through which the light beam is reflected is a first curved face and a second straight face.

7. The optical device of claim 1, wherein the lens further comprises third refractive surfaces through which the light beam enters the lens, arranged between the light source and the first total internal reflection surface, these third surfaces preferably being curved and/or straight.

8. The optical device of claim 1, wherein the lens comprises a height of less than 10 mm.

9. A desk lamp comprising the optical device of any of the claim 1.

10. The desk lamp of claim 9, further comprising a base intended to rest on or be attached to a desk and a support that joins the base to the lens of the optical device, wherein the light source is arranged in the support and wherein the support that joins the base to the light source is rigid.

11. The desk lamp of claim 10, wherein the lens comprises anchoring means that are opposite from anchoring means present in the support.

12. The desk lamp of claim 9, wherein the combined height of the base and the support wherein the light source is integrated is less than 35 cm.

* * * * *